US008779672B2

(12) United States Patent
Bosmuller et al.

(10) Patent No.: US 8,779,672 B2
(45) Date of Patent: Jul. 15, 2014

(54) DRIVER CIRCUIT FOR LIGHT-EMITTING DIODES AND METHOD

(75) Inventors: Peter Bosmuller, Graz (AT); Gilbert Promitzer, Mureck (AT); Andreas Hartberger, Graz (AT)

(73) Assignee: ams AG, Unterpremstätten (AT)

( * ) Notice: Subject to any disclaimer, the term of this patent is extended or adjusted under 35 U.S.C. 154(b) by 0 days.

(21) Appl. No.: 13/695,272

(22) PCT Filed: Apr. 27, 2011

(86) PCT No.: PCT/EP2011/056667

§ 371 (c)(1),
(2), (4) Date: Dec. 27, 2012

(87) PCT Pub. No.: WO2011/135003

PCT Pub. Date: Nov. 3, 2011

(65) Prior Publication Data

US 2013/0113385 A1 May 9, 2013

(30) Foreign Application Priority Data

Apr. 30, 2010 (DE) ..... 10 2010 018 865

(51) Int. Cl.
*H05B 37/00* (2006.01)
*H05B 39/00* (2006.01)

(52) U.S. Cl.
USPC ..... 315/161; 315/160; 315/167; 315/175

(58) Field of Classification Search
None
See application file for complete search history.

(56) References Cited

U.S. PATENT DOCUMENTS

| | | | | |
|---|---|---|---|---|
| 6,160,354 | A | 12/2000 | Ruvinskiy et al. | |
| 6,586,890 | B2 | 7/2003 | Min et al. | |
| 6,690,146 | B2 | 2/2004 | Burgyan et al. | |
| 7,116,086 | B2 | 10/2006 | Burgyan et al. | |
| 7,157,866 | B2 | 1/2007 | Komiya et al. | |
| 7,256,554 | B2 | 8/2007 | Lys | |
| 2005/0128168 | A1 * | 6/2005 | D'Angelo | 345/82 |
| 2007/0182698 | A1 | 8/2007 | Ha et al. | |
| 2010/0026209 | A1 | 2/2010 | Liu | |
| 2010/0172385 | A1 | 7/2010 | Groepl et al. | |
| 2010/0194294 | A1 * | 8/2010 | Kitagawa et al. | 315/161 |
| 2010/0328370 | A1 * | 12/2010 | Takata et al. | 345/694 |

FOREIGN PATENT DOCUMENTS

| | | | |
|---|---|---|---|
| EP | 1471493 | A1 | 10/2004 |
| JP | 2009016685 | A | 1/2009 |
| WO | 2008155385 | A1 | 12/2008 |

* cited by examiner

*Primary Examiner* — Anh Tran
(74) *Attorney, Agent, or Firm* — McDermott Will & Emery LLP

(57) ABSTRACT

Driving circuit comprises a first input, at which a first supply voltage is present, a second input, at which a second supply voltage is present, a first current supply unit selectively coupled to first or second input as function of at least one first control signal, at least one second current supply unit selectively coupled to first or second input as function of at least one second control signal, a control unit connected to first current supply unit and to at least one second current supply unit for respective control thereof and designed to provide at least one first and second control signal, and a first output coupled to first current supply unit to provide a first current for at least one first light-emitting diode, at least one second output coupled to at least one second current supply unit to provide second current for at least one second light-emitting diode.

18 Claims, 4 Drawing Sheets

DRIVER CIRCUIT FOR LIGHT-EMITTING DIODES AND METHOD

Figure 1:
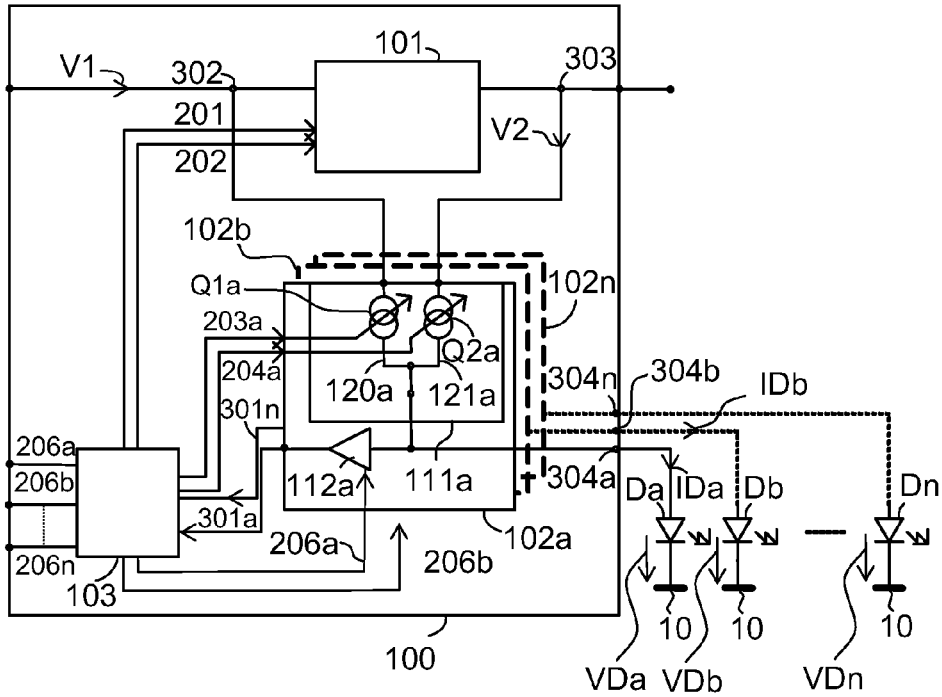

The invention relates to a driver circuit for light-emitting diodes and an associated method.

Light-emitting diodes, LEDs, are increasingly being used for lighting and in displays. A forward voltage of an LED, i.e. the voltage that drops at the LED during operation in the passband, depends, among other things, on the color and construction of the LED. A number of LEDs in a series arrangement or a matrix arrangement are frequently supplied by a single voltage source. The efficiency with which the individual LEDs can be operated varies due to the different forward voltages of the LEDs in an arrangement. In applications with disposable or rechargeable batteries, the output voltage of the battery used as the supply voltage also changes as a function of the respective charge state and battery lifetime.

Known driver circuits for light-emitting diodes use the current flowing through the LED as the control parameter for driving it. The level of the supply voltage, for example, is then derived from this control parameter. Normally exactly one voltage supply is used in this case. This causes problems whenever LEDs with different colors or different constructions are to be controlled by the circuit. A power loss due to a voltage supply that is chosen to be too high, for example, reduces the efficiency and is converted into heat in the driver circuit. If the driver circuit is configured as an integrated circuit, IC, for example, this heat must be dissipated via the package. Since the package has a thermal resistance, an undesired heating of the IC occurs.

If a disposable or rechargeable battery is used to generate the supply voltage, it must also be taken into account that the voltage provided varies according to the lifetime and the charge state.

One objective is to increase the efficiency when operating light-emitting diodes.

The objective is achieved with the subject matter of the independent claims. Refinements and configurations are the subject matter of the dependent claims.

In one embodiment, a driver circuit for light-emitting diodes comprises a first and a second input, a first and at least one second current supply unit, a control unit and a first and at least one second output. A first supply voltage is present at the first input. A second supply voltage is present at the second input. The first current supply unit is selectively coupled to the first or second input as a function of at least one first control signal. The at least one second current supply unit is selectively coupled to the first or second input as a function of at least one second control signal. The control unit is connected to the first and the at least second current supply unit for control thereof. The control unit is designed to provide the at least one first and the at least one second control signal. The first output is coupled to the first current supply unit and is designed to provide a first current for at least one first light-emitting diode. The at least one second output is coupled to the at least one second current supply unit and is designed to provide a second current for at least one second light-emitting diode.

The first current supply unit generates the first current for the at least one first light-emitting diode selectively from the first or the second supply voltage as a function of the at least one first control signal. Controlled by the at least one second control signal, the second current supply unit generates the second current for the at least one second light-emitting diode selectively from the first or the second supply voltage.

Thus both the first and the second current are each provided individually for the first connectable light-emitting diode and the second connectable light-emitting diode at the respectively required level. This makes it possible for both the first and the second light-emitting diode to each be operated with the most favorable supply voltage from the set comprising the first and the second supply voltage. Consequently the efficiency is advantageously increased.

The first and/or the second input is respectively realized as an internal input or an external input. The first supply voltage is supplied externally, for example. The second supply voltage is likewise supplied externally or is provided internally, for example.

The first and the second light-emitting diode are preferably connected by at least one terminal, their respective cathode terminal in particular, to a reference potential terminal.

In a refinement, the at least one first control signal is provided as a function of a specifiable operating range of the at least one first light-emitting diode. The at least one second control signal is provided as a function of a specifiable operating range of the at least one second light-emitting diode.

This ensures that a sufficient supply voltage is available to both the first and the second current supply unit in order to be able to provide the required current with which the respective light-emitting diode is switched on and lights up.

In another embodiment, the first current is provided relative to a luminance of the at least one first light-emitting diode, and the first or the second supply voltage is selected as a function of a first forward voltage of the at least one first light-emitting diode. The second current is provided relative to a luminance of the at least one second light-emitting diode, and the first or the second supply voltage is selected as a function of a second forward voltage of the at least one second light-emitting diode.

The respective operating range of the first and the second light-emitting diode is defined as the area on the characteristic curve of the first or second diode in which it is operated. The respective forward voltage drops at the respective diode in this range. For a required current through the LED, a defined voltage according to the characteristic curve of the LED is necessary at the LED. The driver circuit can advantageously decide which supply voltage, i.e. the first or second supply voltage, is more favorable for the required current. The supply voltage for each individual LED is selected individually and relative to the present operating state. This contributes to a further increase of the efficiency.

The more favorable supply voltage is therefore the one which is closer to the forward voltage of the respective light-emitting diode.

In a refinement, the first supply voltage is variable.

The first supply voltage is generated by a disposable or rechargeable battery, for example. The level of the first supply voltage is consequently variable.

In another embodiment, the second supply voltage is adjustable.

In a refinement, the at least one first and the at least one second control signal each comprises a first source control signal and a second source control signal.

The control unit thus generates a control signal, comprising a first and a second source control signal, for each connectable light-emitting diode. This advantageously enables a separate control of all current supply units, so that the supply voltage is adapted to the operating range of the respective light-emitting diode to be operated.

In a refinement, the first and the at least one second current supply units each comprise a controlled current source and a comparator coupled to the at least one associated controlled current source. The controlled current source is fed respectively with the first or the second supply voltage. The controlled current source is designed to provide the associated first or second current. The comparator is designed to provide a respective operating state signal as a function of the associated first or second current and as a function of an associated activation signal.

The first current supply unit includes a first controlled current source and a first comparator coupled thereto that provides the first operating state signal as a function of the current generated by the first current supply unit and as a function of the first activation signal, which switches the at least one first light-emitting diode operated with the first current on and off.

One activation signal is supplied to the driver circuit for each connectable light-emitting diode. A controlled current source supplies an LED with a constant current. This current value is adjustable, depending on the characteristic curve of the LED in use and on the desired luminous intensity. The comparator, a current comparator for example, tests whether the provided current has a value defined according to the specifiable operating range. The operating state signal is a digital signal that indicates whether the LED is being driven in the desired operating range.

The circuit is operated, for example, in such a manner that all current supply units use the first supply voltage at power-on in order to generate the respective current. Starting from the respective operating state signals, the control unit generates the respective first and second control signals, which control a changeover from the first supply voltage to the second supply voltage for each individual current supply unit.

The comparator can alternatively be implemented as a voltage comparator.

In a refinement, each controlled current source has a first and a second path. The first path comprises a current source that can be adjusted by means of the first source control signal, and to which the first supply voltage is fed. The second path comprises a current source that can be adjusted by means of the second source control signal, and to which the second supply voltage is fed.

For each current supply unit, the controlled current source is adjusted via its source control signals in such a manner that the current to be provided is generated either in the first path or in the second path. The current is generated with the first supply voltage in the first path, and with the second supply voltage in the second path. Thus either the first path or the second path is active.

In an alternative embodiment, each controlled current source has a current source controllable as a function of an associated switch-on signal and connected to the reference potential terminal.

In another embodiment, the control unit is designed to provide the respective first and second source control signals as a function of the respective associated operating state signal and the associated activation signal.

In the control unit, there is a logical linkage of the first activation signal for the at least one first diode and the first operating state signal of the first current supply unit, for example. The result is fed to the first controlled current source in the form of the at least one first control signal, which comprises the first and the second source control signals for the first current source unit.

In a refinement, the driver circuit comprises a voltage converter that is designed to generate at least the second supply voltage as a function of the first supply voltage and as a function of a first and a second converter control signal. The first and the second converter control signals are each provided by the control unit as a function of the operating state signals.

In this embodiment, at least the second supply voltage is generated with the voltage converter from the first supply voltage. In addition, the voltage converter can supply further supply voltages at different levels. The control unit controls the voltage converter with the aid of the first converter control signal, which switches the converter on and off for example, and with the aid of the second converter control signal, which defines the mode of the voltage converter and thus the level of the respectively provided supply voltage, for example. As a function of the evaluation of the operating state signals, the control unit detects whether the voltage converter is switched on and the mode in which it is being operated.

The voltage converter can advantageously remain switched off at the beginning of operation, so long as the first supply voltage is still sufficient to operate the connectable light-emitting diodes in the desired range. The voltage converter is switched on in the required mode only if this is no longer the case.

The level of the second supply voltage is thus adjustable with the aid of the second converter control signal.

The voltage converter is realized, for example, as a charge pump or a switched mode voltage converter. The voltage converter is configured as a step-up or a step-down converter.

In a refinement, the first supply voltage is different from the second supply voltage.

The second supply voltage is therefore larger or smaller than the first supply voltage.

This ensures that even if the level of the first supply voltage, provided by a battery for example declines, a sufficiently high supply voltage, namely the second supply voltage, will be available to provide the respectively required currents for operation of the light-emitting diodes.

In another embodiment, the first current is set up for at least one additional first light-emitting diode that can be connected to the first output. The second current is set up for at least one additional second light-emitting diode that can be connected to the second output.

For the additional first and the additional second light-emitting diodes, the first or the second current, respectively, is again generated at exactly the level required for the operating range of the respective light-emitting diode.

In another embodiment, the driver circuit additionally has a first and a second terminal. The first terminal is connected to the reference potential terminal by means of a first switch controlled by a first switch-on signal that is provided by the control unit as a function of a start signal. The at least one second terminal is connected to the reference potential terminal by means of a second switch controlled by a second switch-on signal that is generated by the control unit as a function of the start signal.

The start signal is fed to the control unit from the exterior. A sequence control realized in the control unit is started with the aid of this start signal. The control unit generates the first and at least the second switch-on signal, by which the first or the second switch is closed. Thus the light-emitting diode connectable to the first or the second terminal is switched on.

In a refinement, the first terminal is designed for connection to the cathode of the first and the at least one second light-emitting diode. The at least one second terminal is designed for connection to the cathode of the one additional first diode and the cathode of the at least one additional second light-emitting diode.

This yields an arrangement of connectable light-emitting diodes in matrix form, e.g. in the form of a 2×2 matrix. The anode of the first light-emitting diode can be coupled to the first output while its cathode can be coupled to the first terminal. The anode of the at least one additional first light-emitting diode can likewise be coupled to the first output and its cathode can be coupled to the second terminal. The switch-on signals and the activation signals ensure that exactly one of the switches is closed and one LED is lit up.

The operating state for each connectable light-emitting diode is advantageously checked in the associated comparator of the associated current supply unit. Thus the voltage that is provided for this LED at the respective output is individually adjusted to the required level. This contributes considerably to increasing the efficiency of the driver circuit.

In another embodiment, the driver circuit is suitable for operating an arrangement of light-emitting diodes in matrix form.

Starting from the above-described driver circuit, additional light-emitting diodes can be connected to the driver circuit, so that a matrix with m rows and n columns results. Each of the connectable light-emitting diodes is selectively driven with the first or the second supply voltage.

In one embodiment, a method comprises the following steps:

supplying a first and a second supply voltage, providing a first current for at least one first light-emitting diode (Da) and selecting a voltage from a set comprising the first and second supply voltages as a function of a first forward voltage of the at least one first light-emitting diode and the first current, providing a second current for at least one second light-emitting diode and selecting a voltage from a set comprising the first and second supply voltages as a function of a second forward voltage of the at least one second light-emitting diode and the second current, and individually changing over between first and second supply voltages as a function of the respectively provided first or second current.

At the beginning of operation there is an attempt to provide a first defined current and at least one second defined current to the at least first and the at least second light-emitting diode with the aid of the first supply voltage. According to the characteristic curves of the LED, a required voltage at the LED results from the current. If the first supply voltage is not sufficient to provide the defined current, there is a changeover to the second supply voltage. The same applies if the first supply voltage falls during the operation sufficiently that the required current can no longer be provided.

This method has the effect of providing the smallest voltage possible that enables driving the required amount of current through the LED. This reduces the lost power and thus increases the efficiency.

The term "individually" means here that the connectable light-emitting diodes have different or equal supply voltages.

A refinement of the method has the following steps:

checking whether the first current through the at least one first light-emitting diode has a first predetermined value, if yes, providing the first current with the aid of the first supply voltage, if no, providing the first current with the aid of the second supply voltage, checking whether the second current through the at least one second light-emitting diode has a second predetermined value, if yes, providing the second current with the aid of the first supply voltage, and if no, providing the second current with the aid of the second supply voltage.

In case the first supply voltage no longer suffices to respectively generate the first or second current at the level necessary for the specifiable operating range, there is a respective change to the second supply voltage. Since the operating state of the respectively switched on LED is constantly checked, there is also the possibility of switching back to the first supply voltage.

Figure 2:
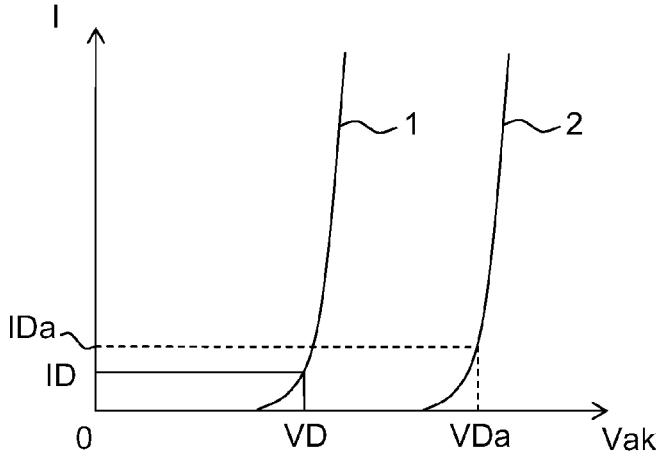
Figure 3:
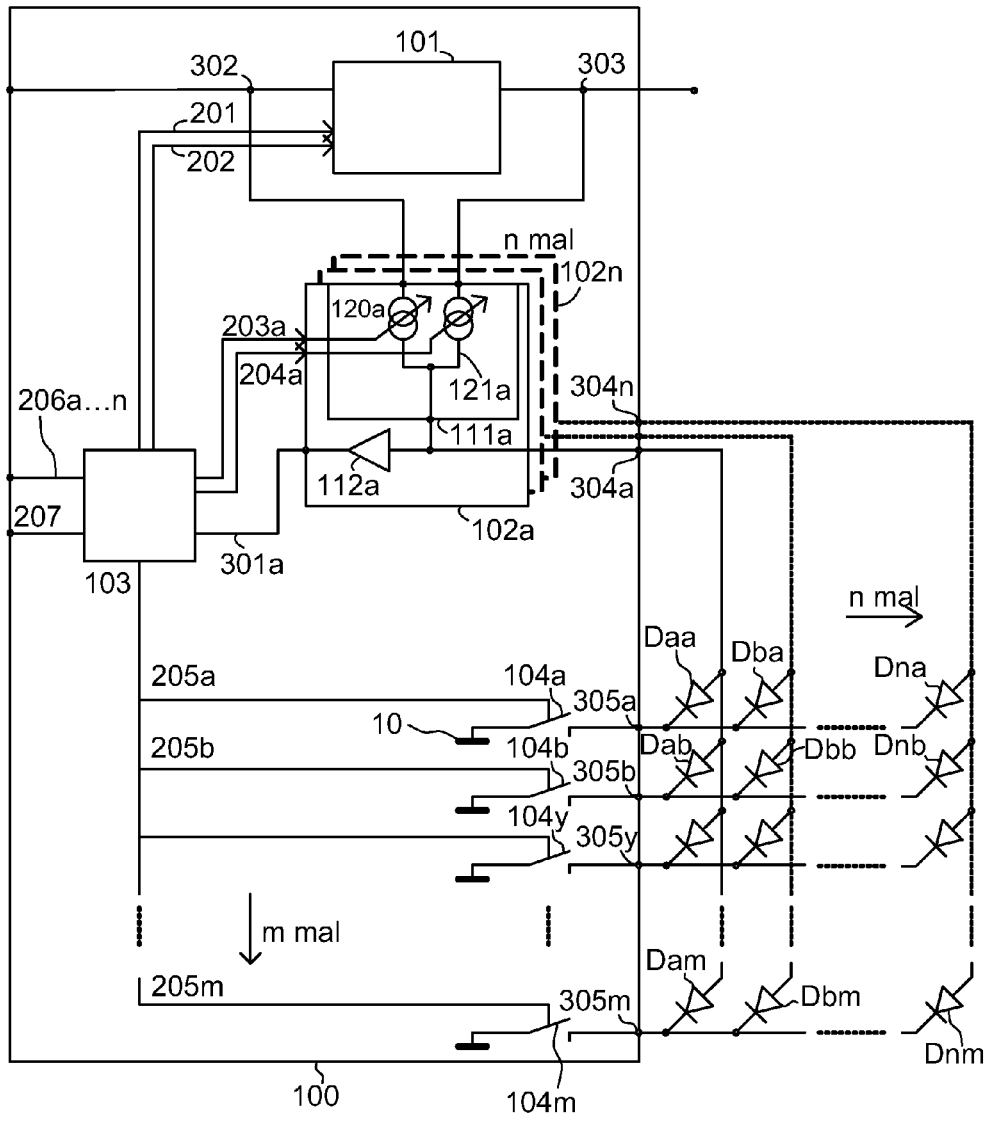
Figure 4:
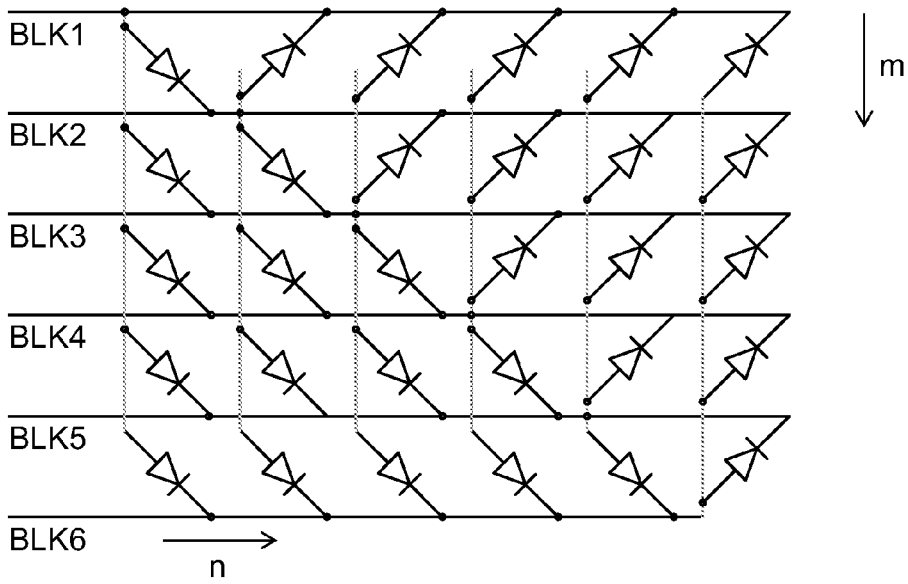
Figure 5:
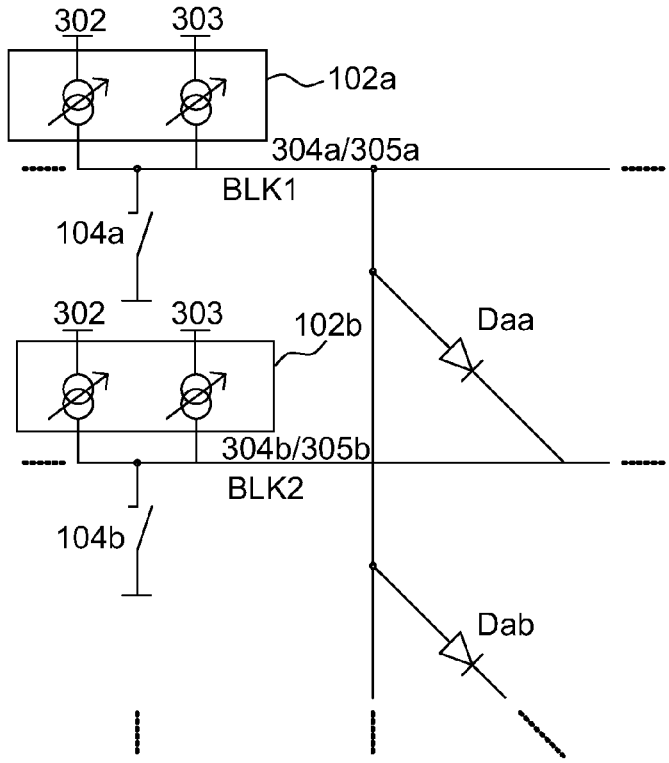
Figure 6:
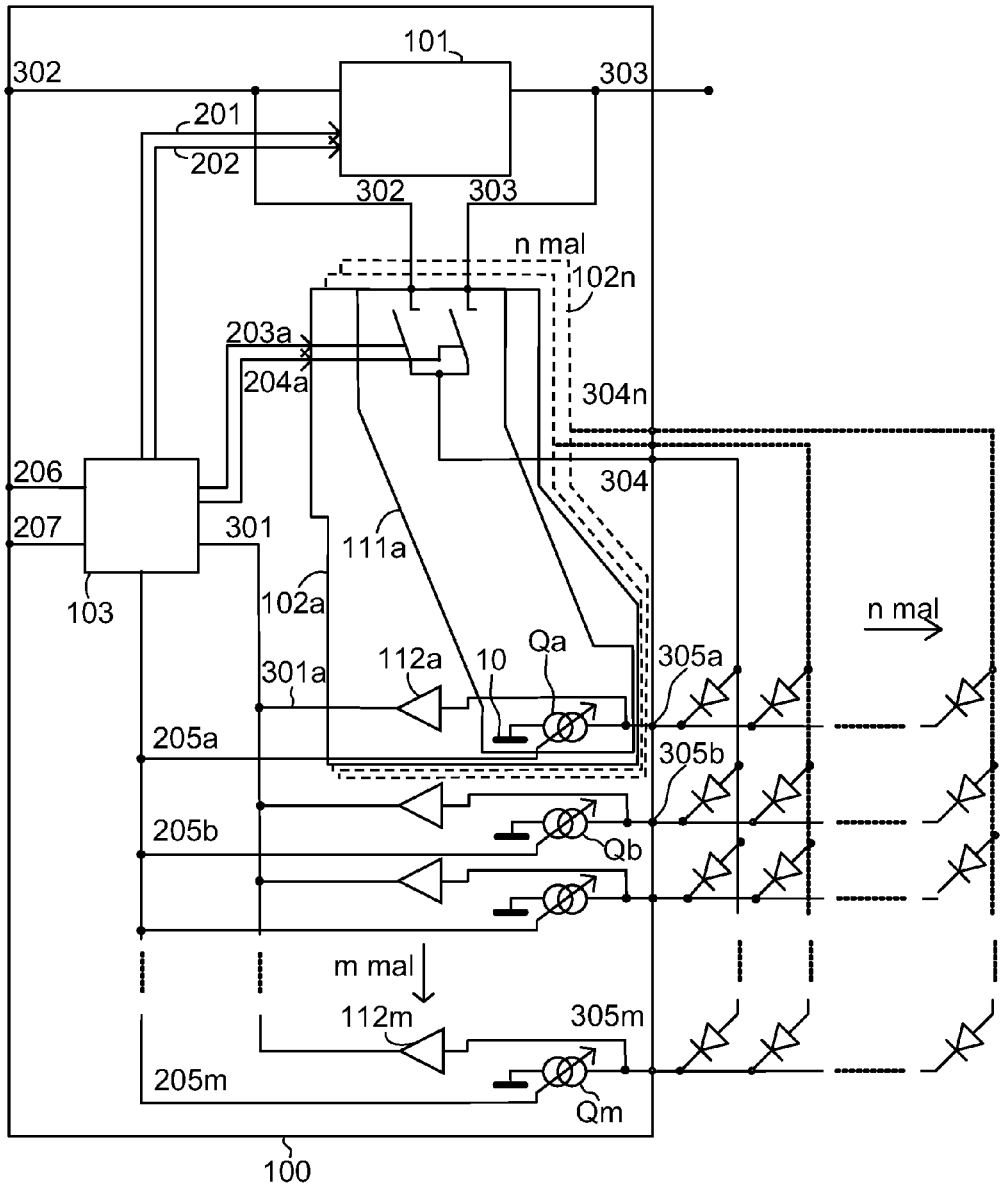

The invention will be described in detail below for several exemplary embodiments with reference to the figures. Components and circuit elements that are functionally identical or have the identical effect bear identical reference numbers. Therein:

FIG. 1 shows a first exemplary embodiment of a driver circuit for light-emitting diodes according to the proposed principle, FIG. 2 shows exemplary characteristic curves of light-emitting diodes, FIG. 3 shows a second exemplary embodiment of a driver circuit for light-emitting diodes according to the proposed principle, FIG. 4 shows an exemplary matrix arrangement of light-emitting diodes, FIG. 5 shows an exemplary connection of the matrix arrangement from FIG. 4 to a driver circuit according to FIG. 3, and FIG. 6 shows another embodiment of the driver circuit for light-emitting diodes according to FIG. 3.

FIG. 1 shows a first embodiment of a driver circuit for light-emitting diodes according to the proposed principle. The driver circuit has a first input 302, to which a first supply voltage V1 is fed, and a second input 303, at which a second supply voltage V2 is present. The driver circuit further comprises a control unit 103, a number n of current supply units 102*a* to 102*n* and a number n of outputs 304*a* to 304*n*. A number n of activation signals 206*a* to 206*n* is supplied to the control unit 103.

A voltage converter 101, to which the first supply voltage V1 is supplied, and which provides the second supply voltage V2, is also provided in this embodiment. The driver circuit further comprises n current supply units 102 to 102*n*. Each current supply unit 102 to 102*n* is selectively coupled to the first input 302 or to the second input 303. Each current supply unit 102*x* is linked to the associated output 304*x*. X represents a letter from the set a through n. For example, the first current supply unit 102*a* is linked to the first output 304*a*. The second current supply unit 102*b* is linked to the second output 304*b*. The nth current supply unit 102*n* is linked to the nth output 304*n*.

A light-emitting diode Dx can be connected to each output 304*x*. For example, a first light-emitting diode Da can be connected to the first output 304*a*. A second diode Db can be connected to the second output 304*b*. An nth diode Dn can be connected to the nth output 304*n*. Each light-emitting diode Dx is also connected to a reference potential terminal 10. In particular it is directly connected to the reference potential terminal 10. Thus for each connectable light-emitting diode Dx a separate current supply unit 102*x* is provided.

The first supply voltage V1 is supplied externally to the driver circuit, from a disposable or rechargeable battery, for example. The first supply voltage V1 is thus variable. Controlled by a first converter control signal and a second converter control signal 201, 202 supplied by the control unit 103, the voltage converter 101 generates the second supply voltage V2 from the first supply voltage V1. In a typical implementation, the ratio of the first supply voltage V1 to the second supply voltage V2 is 2:3 or 1:2. In a realization in which the first supply voltage V1 is fed from a battery, the level of the supply voltage V1 depends on the charge state and the load of this battery and is therefore variable. These changes also have an effect on the second supply voltage V2. The first and second converter control signals 201, 202 are defined by the control unit 103. The voltage converter 101 is turned on and off with the converter control signal 201. The second converter control signal 202 switches the ratio of the voltage gain from voltage converter 101 between different modes available, such as a 2:3 or a 1:2 mode.

Each current supply 102*x* has a controlled current source 111*x* and a comparator 112*x*. The controlled current source 111*x* has two paths, namely a first path 120*x* with a first adjustable current source Q1 and a second path 121*x* with a second adjustable current source Q2. The first adjustable current source Q1 is controlled by a first source control signal 203*x*. The second adjustable current source Q2 is controlled by a second source control signal 204*x*. The first supply voltage V1 is fed to the first path 120*x*. The second supply voltage V2 is fed to the second path 121*x*. The first controlled current source 111*x* thus generates a current IDx. This is fed to the associated output 304*x* as well as to the associated comparator 112*x*. The comparator 112*x* checks whether the current IDx lies within a desired range when the associated activation signal 206*x* is present. As a result, the comparator 112*x* provides an operating state signal 301*x* that is supplied to the control logic 103. Accordingly the control unit 103 activates the first or the second path 120*x*, 121*x* of the current supply unit 102*x* with the aid of the first and second source control signals 203*x* and 204*x*.

The current supply units 102*a* to 102*n* are thus adjusted in such a manner that in each case they choose the more favorable voltage from the set consisting of the first and the second supply voltage V1, V2 for providing the respective current IDx. This has the effect that the selected supply voltage is as close as possible to a forward voltage VDx of the light-emitting diode to be operated. This advantageously reduces the lost power in the circuit.

Each activation signal 206*x* provides the information of whether a light-emitting diode Dx is switched on or off. This information is also available to the associated comparator 112*x* of the current supply unit 102*x*, so that the comparator 112*x* is active only if an LED Dx is switched on.

Thus a number n of LEDs that are arranged in series are driven with the illustrated exemplary embodiment of the driver circuit. Each of these LEDs is supplied by its own associated current supply unit 102*x*. Each LED is operated individually, depending on its forward voltage VDx, with the first or with the second supply voltage V1, V2, because the source control signals 203*x* and 204*x* are also implemented n times. An operating state signal 301*x* is generated for each LED Dx by the associated comparator 112*x*. This information indicates whether the respective LED Dx is being operated in the desired operating range. A changeover between first and second supply voltages V1, V2 is accordingly initiated by the control unit 103.

FIG. 2 shows exemplary characteristic curves of light-emitting diodes. The abscissa represents a progression of an anode to cathode voltage Vak of a light-emitting diode, whereas the progression of the diode current I is represented on the ordinate. Two characteristic curves 1 and 2 are displayed. In these characteristic curves with the typical progression of an exponential function, it is recognizable that a forward voltage is achieved in each case shortly after the inflection. The forward voltage VD is achieved somewhat earlier in the characteristic curve 1 than in the characteristic curve 2, whose forward voltage VDa is achieved somewhat later. The forward voltage VD of characteristic curve 1 corresponds to a current ID through the corresponding light-emitting diode. The forward voltage VDa of characteristic curve 2 corresponds to a current IDa through another light-emitting diode. The forward voltage VD or VDa is thus typically the voltage at which a light-emitting diode can just barely be switched on. The operating range of the diode is therefore chosen in such a manner that the voltage at the diode is greater than the forward voltage. The comparators 112*x* from FIG. 1 check whether the voltage dropping at the diode is sufficiently large to allow the required current to flow through the diode.

FIG. 3 shows a second exemplary embodiment of a driver circuit according to the proposed principle. In contrast to the exemplary embodiment of FIG. 1, the light-emitting diodes in this embodiment are arranged in an n×m matrix. For this purpose, m terminals 305*a* to 305*m* are provided in the driver circuit 100*m*. In addition, m switches 104 to 104*m* are provided, each switch 104*y* being coupled to an associated terminal 305*y*. Y is a letter from the set of letters a to y. In addition, m switch-on signals 205*a* to 205*m* are provided. Each switch 104*y* is driven by a switch-on signal 205*y*. A start signal 207 is additionally fed to the control unit 103. The start signal 207 initializes a finite state automaton realized in the control unit 103 that makes the switch-on signals 205*a* to 205*m* available as logic signals in a suitable sequence in order to close each of the switches 104*a* to 104*m*, one at a time. When a switch 104*y* is closed, the associated terminal 305*y* is coupled to the reference potential terminal 10. A diode Dxy coupled to the terminal 305*y* is switched on, additionally controlled by the respective activation signal 206*x*.

The matrix of light-emitting diodes thus comprises n columns and m rows. The m rows are switched on in sequence by respective closure of one of the switches 104*a*-104*m*, according to the implementation of the finite state automaton in the control unit 103. As was already the case in the exemplary embodiment of FIG. 1, each of the n LEDs in a row is provided with its own current supply unit 102*x*. Thus the supply voltage for each individual light-emitting diode Dxy in the matrix is derived either from the first or from the second supply voltage V1, V2. Each comparator 112*x* provides the associated operating state signal 301*x*, so that the control unit 103 can control the voltage converter 101 accordingly and can activate the first or second path in the associated current supply unit 102*x*. A respective state of the operating state signal 301*x* is stored in the control unit 103.

In an exemplary sequence, the voltage converter 101 is off when the driver circuit 100 is powered on. As soon as the control unit 103 recognizes that a current lower than the expected current IDx is flowing through a switched-on LED Dxy, then the voltage converter 101 is switched on by the first converter control signal 201. The lowest available voltage increase, such as a 2:3 mode, is selected for the second supply voltage V2. The current supply unit 102X associated with the respective LED Dxy is operated via the respective first and second source control signal 203*x* and 204*x* with the second supply voltage V2. Additional light-emitting diodes are only connected to the second supply voltage V2 when the corresponding comparator 112 recognizes that a current less than that which was adjusted is flowing through a light-emitting diode. If the level of the second supply voltage V2 no longer suffices in further operation to generate the desired current flow through an LED, then the control unit 103 can further increase, via the second converter control signal 202, the ratio of the voltage increase in the voltage converter 101, to a 1:2 mode for example. Thereby the second supply voltage V2 is provided at the appropriate level. Even in this matrix arrangement, the operating state is individually assessed for each connected LED and the supply voltage of the associated current supply unit 102 is adapted accordingly.

In further operation, the control unit 103 can also check whether to return to the first supply voltage V1, depending on certain specifiable parameters such as time or voltage. If information is supplied via the operating state signals 301*x* that the first supply voltage V1 is sufficient to operate a respective diode, the voltage converter 101 can even be switched off.

In another embodiment, the voltage converter 101 is replaced by an additional external voltage supply.

In another embodiment, the voltage converter 101 simultaneously generates an additional second supply voltage V22 in order to further optimize the adjustment to the operating state of the connected light-emitting diode. The voltage converter 101 can also have gain ratios different from the cited values of 2:3 and 1:2.

FIG. 4 shows an exemplary matrix arrangement of light-emitting diodes. The illustrated matrix is configured so that the functions of the terminals 305-305*m* from FIG. 3 are adopted by means of multiplexing from the outputs 304-304*n*. As in FIG. 3, exactly one light-emitting diode is switched on by a respective block signal BLK1-BLKm.

This has the advantageous effect that the number of terminals in the driver circuit 100 is markedly reduced. If the driver circuit 100 is realized as an integrated circuit, the number of pins is therefore markedly reduced.

FIG. 5 shows an exemplary connection of the arrangement from FIG. 4 to the driver circuit according to FIG. 3. In order to switch on the first diode D, the current IDa generated by the current supply unit 102*a* is transmitted via the first block signal BLK1. With the second block control line BLK2, the first diode Da is linked via the switch 104*b* to the reference potential terminal 10.

FIG. 6 shows another embodiment of a driver circuit for light-emitting diodes according to FIG. 3. In this embodiment, compared to that of FIG. 3, each controlled current source 111*a*, 111*b* is configured so that it has a current source Qa, Qb, controllable as a function of the associated switch-on signal 205*a*, 205*b* and connected to the reference potential terminal 10. Each controlled current source 111*a*, 111*b* is additionally coupled to the associated terminal 305*a*, 305*b*.

For example, the controllable current source Qa of the first controlled current source 111*a* is switched on or off by means of the associated first switch-on signal 205*a*. The first comparator 112*a* provides the acquired first operating state signal 301*a*. On this basis, the control unit 103 selects the supply voltage to be fed to the controllable current source Qa from the set comprising the first and the second supply voltages V1, V2 and activates the first controlled current source 102A with the aid of the associated first source control signal 203*a* and the associated second source control terminal 204*a*.

LIST OF REFERENCE NUMBERS

Da, . . . , Dn Light-emitting diode
V1, V2, Vak Voltage
302, 303 Input
304*a*, . . . , 304*n* Terminal
201, 202, 207 Signal
203*a*, . . . , 203*n* Signal
204*a*, . . . , 204*n* Signal
205*a*, . . . , 205*m* Signal
206*a*, . . . , 206*n* Signal
301*a*, . . . , 301*n* Signal
103 Control unit
104*a*, . . . , 104*m* Switch
102*a*, . . . , 102*n* Current supply unit
111*a*, . . . , 111*n* Controlled current source
112*a*, . . . , 112*n* Comparator
101 Voltage converter
100 Driver circuit
10 Reference potential terminal
I, ID, Ida, . . . , IDn Current
VD, VDa, . . . , VDn Voltage
Q1*a*, . . . , Q1*n* Current source
Q2*a*, . . . , Q2*n* Current source
Qa, Qb Current source
BLK1, . . . , BLKm Block signal

What is claimed is:

1. A driver circuit for light-emitting diodes, comprising:
a first input, at which a first supply voltage is present;
a second input, at which a second supply voltage is present;
a first current supply unit, which is selectively coupled to the first or the second input as a function of at least one first control signal;
at least one second current supply unit, which is selectively coupled to the first or second input as a function of at least one second control signal;
a control unit, that is connected to the first current supply unit and to the at least one second current supply unit for respective control thereof, and which is designed to provide the at least one first and the at least one second control signal;
a first output coupled to the first current supply unit to provide a first current for at least one first light-emitting diode; and
at least one second output coupled to the at least one second current supply unit to provide a second current for at least one second light-emitting diode,
wherein the first and the at least one second current supply unit respectively comprise:
a controlled current source, to which the first or second supply voltage is fed and which is designed to provide the associated first or second current; and
a comparator that is coupled to the respectively associated controlled current source and is designed to provide a respective operating state signal as a function of the associated first or second current and of an associated activation signal, the comparator corresponding to a current comparator.

2. A driver circuit according to claim 1, wherein the at least one first control signal is provided as a function of a specifiable operating range of the at least one first light-emitting diode, and
wherein the at least one second control signal is provided as a function of a specifiable operating range of the at least one second light-emitting diode.

3. A driver circuit according to claim 1 or 2, wherein the first current is provided relative to a luminance of the at least one first light-emitting diode, and the first or the second supply voltage is selected as a function of a first forward voltage of the at least one first light-emitting diode and the first current, and
wherein the second current is provided relative to a luminance of the at least one second light-emitting diode, and the first or the second supply voltage is selected as a function of a second forward voltage of the at least one second light-emitting diode and the second current.

4. A driver circuit according to claim 1, wherein the first supply voltage is variable.

5. A driver circuit according to claim 1, wherein the second supply voltage is adjustable.

6. A driver circuit according to claim 1, wherein the at least one first and the at least one second control signal respectively comprises a first source control signal and a second source control signal.

7. A driver circuit according to claim 1, wherein each controlled current source comprises:

a first path, with a first current source, adjustable by means of the first source control signal, to which the first supply voltage is fed; and a second path, with a second current source, adjustable by means of the second source control signal, to which the second supply voltage is fed.

8. A driver circuit according to claim 1, wherein each controlled current source comprises a current source that can be controlled as a function of an associated switch-on signal and is connected to a reference potential terminal.

9. A driver circuit according to claim 1, wherein the control unit is designed to respectively provide the first and second source control signals as a function of the associated operating state signal and the associated activation signal.

10. A driver circuit according to claim 1, further comprising a voltage converter that is designed to generate at least the second supply voltage as a function of the first supply voltage, and as a function of a first and second converter control signal, respectively provided by the control unit as a function of the operating state signals.

11. A driver circuit according to claim 1, wherein the first supply voltage is different from the second supply voltage.

12. A driver circuit according to claim 1, wherein the first current is set up for at least one additional first light-emitting diode that can be connected to the first output, and wherein the second current is set up for at least one additional second light-emitting diode that can be connected to the second output.

13. A driver circuit according to claim 12, further comprising:

a first terminal, which is connected by means of a first switch, controlled by a first switch-on signal provided by the control unit as a function of a start signal, to a reference potential terminal; and at least one second terminal, which is connected by means of a second switch, controlled by a second switch-on signal provided by the control unit as a function of the start signal, to the reference potential terminal.

14. A driver circuit according to claim 13, wherein the first terminal is designed for connection to the cathode of the first and the at least one second light-emitting diode, and wherein the at least one second terminal is designed for connection to the cathode of the one additional first light-emitting diode and the at least one additional second light-emitting diode.

15. A driver circuit according to claim 1, that is suitable for operating an arrangement of light-emitting diodes in matrix form.

16. A method comprising the following steps:

supplying a first and a second supply voltage;

providing a first current for at least one first light-emitting diode and selecting a voltage from a set comprising the first and the second supply voltages as a function of a first forward voltage of the at least one first light-emitting diode and the first current;

providing a second current for at least one second light-emitting diode and selecting a voltage from a set comprising the first and a second supply voltages as a function of a second forward voltage of the at least one second light-emitting diode and the second current; and individually changing over between first and second supply voltage as a function of the respectively provided first or second current;

checking whether the first current through the at least one first light-emitting diode has a first predetermined value;

if yes, providing the first current with the aid of the first supply voltage;

if no, providing the first current with the aid of the second supply voltage; and checking whether the second current through the at least one second light-emitting diode has a second predetermined value;

if yes, providing the second current with the aid of the first supply voltage; and if no, providing the second current with the aid of the second supply voltage.

17. A driver circuit for light-emitting diodes, comprising:

a first input, at which a first supply voltage is present;

a second input, at which a second supply voltage is present;

a first current supply unit, which is selectively coupled to the first or the second input as a function of at least one first control signal;

at least one second current supply unit, which is selectively coupled to the first or second input as a function of at least one second control signal;

a control unit, that is connected to the first current supply unit and to the at least one second current supply unit for respective control thereof, and which is designed to provide the at least one first and the at least one second control signal;

a first output coupled to the first current supply unit to provide a first current for at least one first light-emitting diode;

at least one second output coupled to the at least one second current supply unit to provide a second current for at least one second light-emitting diode, wherein the first and the at least one second current supply unit respectively comprise:

a controlled current source, to which the first or second supply voltage is fed and which is designed to provide the associated first or second current; and a comparator that is coupled to the respectively associated controlled current source and is designed to provide a respective operating state signal as a function of the associated first or second current and of an associated activation signal; and a voltage converter that is designed to generate at least the second supply voltage as a function of the first supply voltage, and as a function of a first and second converter control signal, respectively provided by the control unit as a function of the operating state signals.

18. A method comprising the following steps:

supplying a first and a second supply voltage;

providing a first current for at least one first light-emitting diode and selecting a voltage from a set comprising the first and the second supply voltages as a function of a first forward voltage of the at least one first light-emitting diode and the first current;

providing a second current for at least one second light-emitting diode and selecting a voltage from a set comprising the first and a second supply voltages as a function of a second forward voltage of the at least one second light-emitting diode and the second current; and individually changing over between first and second supply voltage as a function of the respectively provided first or second current;

checking whether the first current through the at least one first light-emitting diode has a first predetermined value;

if yes, providing the first current with the aid of the first supply voltage;

if no, providing the first current with the aid of the second supply voltage; and checking whether the second current through the at least one second light-emitting diode has a second predetermined value;

if yes, providing the second current with the aid of the first supply voltage; and if no, providing the second current with the aid of the second supply voltage; and generating at least the second supply voltage as a function of the first supply voltage, and as a function of a first and second converter control signal, respectively provided as a function of operating state signals, the operating state signals being provided as a function of the associated first or second current and of an associated activation signal.

* * * * *